United States Patent [19]

Belcher

[11] 4,306,212

[45] Dec. 15, 1981

[54] ELECTRIC FUSE FOR ELEVATED CIRCUIT VOLTAGES

[75] Inventor: Richard A. Belcher, Hampton Falls, N.H.

[73] Assignee: Gould Inc., Rolling Meadows, Ill.

[21] Appl. No.: 185,089

[22] Filed: Sep. 8, 1980

[51] Int. Cl.[3] ..... H01H 85/30

[52] U.S. Cl. ..... 337/244; 337/267

[58] Field of Search ..... 337/241, 244, 265, 267

[56] References Cited

U.S. PATENT DOCUMENTS

| | | | |
|---|---|---|---|
| 3,621,433 | 11/1971 | Belcher | 337/244 |
| 3,832,665 | 8/1974 | Belcher | 337/244 |
| 4,001,749 | 1/1977 | Kozacka | 337/244 |
| 4,204,182 | 5/1980 | Knapp | 337/244 |

*Primary Examiner*—George Harris

*Attorney, Agent, or Firm*—Erwin Salzer

[57] ABSTRACT

A fuse for elevated circuit voltages having a blown fuse indicator. The fuse is characterized by its great simplicity of design. Virtually all its components, or constituent parts, form a sub-assembly capable of being inserted as a unit into the fuse tube or casing. One terminal of the fuse is formed by a plug contact that defines a heating chamber for heating one end of the restraining wire for the blown fuse indicator above all other points thereof. The other terminal of the fuse is formed by a ferrule, or terminal cap, conductively connected to a perforated metal disk, or metal plate, arranged immediately adjacent thereto. That disk or plate performs four functions, namely (1) to help support insulating rods around which the fusible element is helically wound, (2) to form one of the terminals of the fusible element and of the restraining wire for the blown fuse indicator, and (3) to provide a large aperture through which the fuse is easily filled with arc-quenching filler.

4 Claims, 3 Drawing Figures

ELECTRIC FUSE FOR ELEVATED CIRCUIT VOLTAGES

BACKGROUND OF THE INVENTION

The prior art closest to the present invention known is U.S. Pat. No. 3,832,665; Aug. 27, 1974 to A. Belcher for BLOWN FUSE INDICATOR FOR HIGH-VOLTAGE FUSES. U.S. Pat. No. 3,621,433; Nov. 16, 1971 to R. A. Belcher for ELECTRIC FUSE HAVING PLUG TERMINALS is also of interest as prior art.

The simplicity of the fuse according to this invention is in part due to the fact that all its component parts form a bench-assembly capable of being inserted as a whole by one single act into the casing, or fuse tube.

Another reason for the simplicity of this invention is also the fact that the aforementioned bench-assembly is itself of great simplicity and easily to be assembled.

Further features of this invention and advantages thereof will become more apparent as this specification proceeds.

A fuse according to this invention comprises (a) a tubular casing of heat resistant and heat shock resistant electric insulating material such as e.g., a synthetic resin glass cloth laminate;

(b) a metal plug having a predetermined outer diameter inserted into one end of said casing and plugging said one end;

(c) said plug having a coaxial extension integral with said plug, extending beyond said casing and having a smaller outer diameter than said plug;

(d) said plug and said extension are tubular, i.e. they define a passageway in a direction longitudinally thereof;

(e) a spring-biased blown fuse indicator arranged inside said passageway is positioned at the axially outer end thereof;

(f) a plurality of parallel rods of an electric insulating material defining a prismatic space is supported on one end thereof by said plug;

(g) a perforated metal disk arranged inside said casing positioned close to the other end thereof is supporting the other end of said plurality of parallel rods;

(h) a fusible element wound in several turns substantially helically around said plurality of rods and conductively connecting said plug to said perforated disk;

(i) a restraining wire for said blown fuse indicator of which one end is conductively connected to said perforated disk and the opposite end is conductively connected to said blown fuse indicator;

(j) a cover covering the axially inner end of said passageway, said restraining wire being threaded through an aperture in said cover and an abutment on said restraining wire engaging said cover and precluding movement of said cover away from said axially inner end of said passageway;

(k) a pulverulent arc-quenching filler inside said casing filling the entire volume thereof not occupied by other parts;

(l) said plug and said extension thereof, said spring-biased blown fuse indicator, said restraining wire, said cover for said passageway, said plurality of rods of electric insulating material, said fusible element and said perforated disk, forming a sub-assembly capable of being introduced into said casing from one end thereof; and (m) a ferrule mounted on said casing adjacent said perforated metal disk and engaging with the lateral walls thereof the lateral walls of said casing.

DESCRIPTION OF PREFERRED EMBODIMENT

Figure 1:
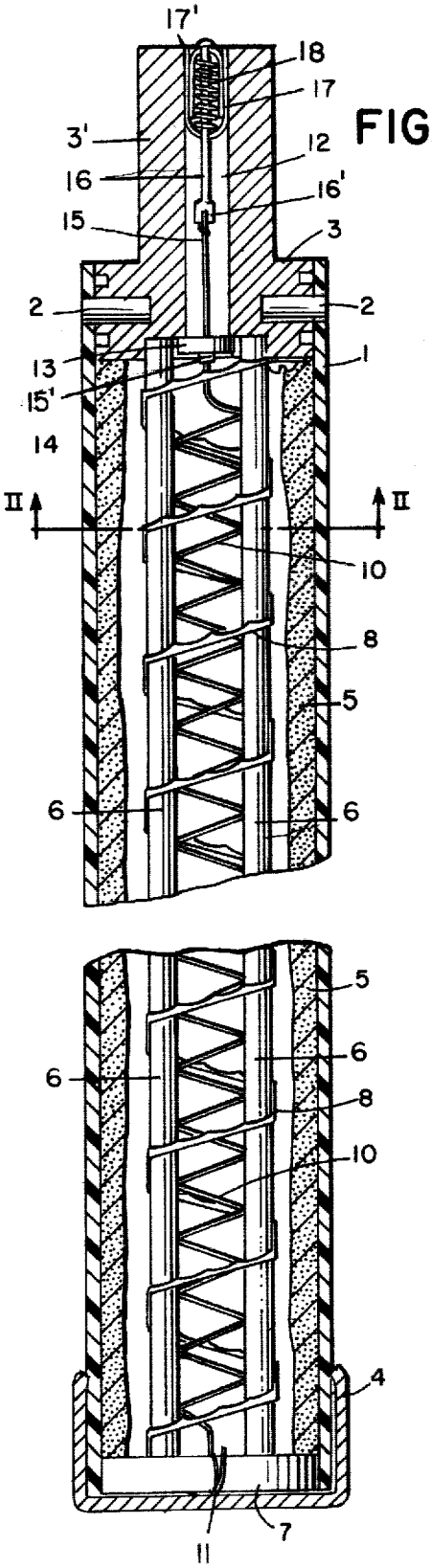
FIG. 1 is substantially a longitudinal section of an electric fuse embodying this invention with some of its parts shown in front elevation rather than sectionalized.

Referring now to the drawings, numeral 1 has been applied to indicate a tubular casing or fuse tube of electric insulating material, such as a laminate of glass-cloth and a synthetic resin, e.g. melamine. The casing 1 is closed on the top end thereof by a plug 3 whose outer diameter is equal to the inner diameter of casing 1. Pins 2 project through casing 1 into plug 3, thus affixing plug 3 to casing 1. Plug 3 has an upper portion 3' which has a smaller outer diameter than plug 3 proper, and which projects above casing 1. This upper portion houses spring biased means to indicate whether or not the fuse has blown, which will be described below in greater detail.

The lower end of the casing 1 is closed by a terminal cap 4 which engages the outer surface of casing 1 and whose axially inner ends may be crimped into casing 1.

Casing 1 is filled with a pulverulent or granular arc-quenching filler 5 which occupies all of its interior which is not occupied by other fuse parts. In the interest of great clarity filler 5 has only been shown at the interface with casing 1.

Figure 3:
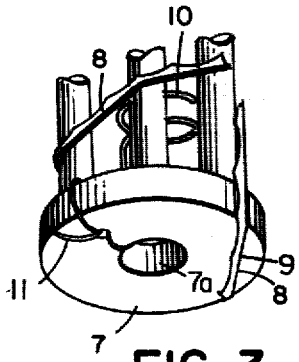
FIG. 3 is an isometric view of some of the parts shown in FIG. 1 at the lower end of the casing, fuse or fuse tube.
Figure 2:
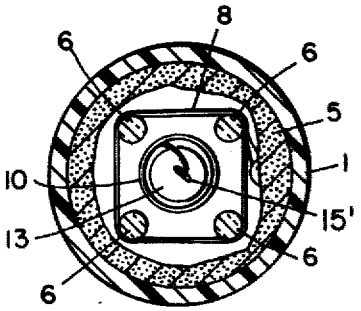
FIG. 2 is a transverse section of the fuse shown in FIG. 1 taken along II—II of FIG. 1.

The metal disk 7 includes openings. FIG. 3 shows at 7A, one such opening. In addition thereto metal disk 7 has four bores arranged to form a square pattern. A congruent pattern of bores is formed in the axially inner end of plug 3. A rod 6 is inserted with one end into each bore in metal disk 7 and with the opposite end into each bore in terminal plug 3. Rods 6 are of an electric insulating material, preferably a ceramic material, and form a kind of prismatic cage around which fusible element 8 is wound in substantially helical fashion. The lower end of fusible element 8 is soldered or welded to the axially outer end surface of part 7 (see FIG. 3), as indicated at 9. Wire 10 shunts fusible element 8. Wires 10 and 15 may be formed by a single length of wire or by two serially connected wires. The wire 15 is stressed by spring 18 of the blown fuse indicator. The lower end of wire 10 is threaded repeatedly through an aperture in disk 7 as shown at the bottom of FIG. 1 and in FIG. 3 and conductively connected to cap 4.

Fusible element 8 is scalloped, small area cross-section alternating with large area cross-sections. This is done for the control of the arc voltage and described in greater detail inter alia in U.S. Pat. No. 3,743,994; July 3, 1973 to Federick J. Kozacka for RIBBON-TYPE FUSIBLE ELEMENT FOR HIGH-VOLTAGE FUSES AND FUSE INCLUDING THE ELEMENT. Reference may be had to this patent for more information in regard to the geometry of fusible element 8.

In addition to the current-carrying fusible element 8 the fuse is provided with the above referred-to auxiliary fusible element 10 comprising a helical winding 10 arranged in coaxial relation to current-carrying element 8 inside of the cage formed by rods 6. Wire 10 consists of a high resistance material, e.g. stainless steel and it may form a continuation of wire 15. The electrical connection between parts 7 and 10 has been indicated by numeral 11.

The upper part or section 3' of plug 3 defines a coaxial chamber 12. The lower or axially inner end of chamber 12 is closed by a disk or cover 13, preventing the arc-quenching filler 5 from entering chamber 12. Disk 13 is provided in the center thereof with a bore through which wire 10 enters into chamber 12, reference numeral 15 indicating the portion of wire 10 inside chamber 12. A helically wound wire 18 forming a compression spring is enclosed between a pair of capsules 17 and 17' of which the former is frictionally firmly engaged by part 3', and hence immovable relative to part 3'. Rod 16 projects through capsules 17 and 17' and is enlarged on its lower end to form a perforated tab 16'. One end of wire 15 is threaded through the perforation in tab 16' and thus affixed to tab 16'. The end of wire 15 outside chamber 12 which is threaded through disk 13 is provided with a knot or the like abutment preventing any relative movement of disk 13 and wire 15 as long as wire 15 is intact.

When fusible element 8 melts, wires 10 and 15 become current-carrying. Since wire 10 is surrounded by the arc-quenching filler 5 which is a good conductor of heat, and wire 15 is surrounded by air, which is a bad conductor of heat relative to that of filler 5, the hottest point of wires 10,15 will be inside chamber 12. When wire 15 melts and its current path is interrupted, spring 18 expands and drives capsule 17' out of channel or passage 12, thus indicating that the fuse has blown.

The fuse is assembled from the lower end thereof. To this end the complete assembly 3,3',6,8,7,10,15, etc. is inserted as a unit or a whole into the lower end of casing 1, and held thereafter therein by pins 2. Thereafter, arc-quenching filler 5 is conveniently admitted through aperture 7*a* in disk 7, whereupon ferrule 4 is mounted on casing 1.

It will be apparent from the above that the auxiliary current path of the blown fuse indicator which becomes only energized when the main current path is interrupted is as follows: 4,7,10, 15,16',16,17'17,3'.

It will be apparent from the foregoing that wires 10 and 15 may be two separate wires connected in series, or one single wire only.

I claim as my invention:

1. An electric fuse for elevated circuit voltages comprising (a) a tubular casing of heat resistant electric insulating material;

(b) a plug having a predetermined outer diameter inserted into one end of said casing;

(c) said plug having a coaxial extension integral with said plug extending beyond said casing and having a smaller outer diameter than said plug;

(d) a passageway extending through said plug and said extension in a direction longitudinally thereof;

(e) a blown fuse indicator arranged inside said passageway at the axially outer end thereof and including a biasing spring;

(f) a plurality of parallel rods of an electric insulating material defining a prismatic space supported on one end thereof by said plug;

(g) a metal disk having holes therein arranged inside said casing positioned close to the other end thereof and supporting the other end of said plurality of rods;

(h) a fusible element wound in several turns substantially helically around said plurality of rods and conductively connecting said plug to said metal disk;

(i) a restraining wire for said biasing spring of said blown fuse indicator of which one end is conductively connected to said metal disk having holes therein, the opposite end is conductively connected to said coaxial extension of said plug, while in an intermediate portion of said restraining wire is passed through said passageway;

(j) a cover covering the axially inner end of said passageway, said restraining wire being threaded through an aperture in said cover and having an abutment engaging said cover under the action of said biasing spring of said blown fuse indicator;

(k) a pulverulent arc-quenching filler inside said casing;

(l) said plug and said extension thereof, said blown fuse indicator, said cover of said passageway, said plurality of rods, said fusible element, said restraining wire, and said metal disk having holes therein forming a unitary sub-assembly capable of being introduced as a whole into said casing from one end thereof; and (m) a ferrule mounted on said casing adjacent said perforated metal disk and engaging with the lateral walls thereof the lateral walls of said casing.

2. An electric fuse for elevated circuit voltages comprising (a) a fuse tube of synthetic resin glass cloth laminate;

(b) a unitary tubular metal member having a first section whose outer diameter is equal to the inner diameter of said fuse tube and inserted into and affixed to one end of said fuse tube, said tubular member further having a second section of smaller outer diameter than said first section projecting axially outwardly from said fuse tube;

(c) a blown fuse indicator including a biasing spring, said blown fuse indicator being arranged adjacent the axially outer end of said second section of said tubular metal member;

(d) a restraining wire for said biasing spring of said blown fuse indicator arranged in part inside said tubular metal member in spaced relation from the walls thereof, said restraining wire further including a portion outside said tubular member;

(e) a cover covering the end of said tubular metal member remote from said blown fuse indicator, said cover having a small aperture for passing said restraining wire through said cover, and an abutment on said restraining wire engaging the side of said cover outside said tubular member for clamping said cover under the action of said biasing spring against said tubular metal member;

(f) a current-carrying disk arranged inside said fuse tube at the end thereof remote from said tubular metal member having at least one cut-out portion for the admission of a pulverulent arc-quenching filler into said fuse tube;

(g) a plurality of spaced rods of electric insulating material arranged in the form of the lateral edges of a prism, one of the ends of said plurality of rods being affixed to the axially inner ends of said tubular metal member and the opposite ends of said plurality of rods being affixed to said current-carrying disk;

(h) a fusible element wound substantially helically around said plurality of rods, having one end conductively connected to said tubular member and the opposite end conductively connected to said current-carrying disk;

(i) said portion of said restraining wire outside said tubular member having one end conductively connected to said current-carrying disk;

(j) a pulverulent arc-quenching filler inside said fuse tube; and (k) a ferrule closing the other end of said fuse tube and overlapping the side wall thereof.

3. An electric fuse as specified in claim 2 wherein said fuse tube is a pultruded tube comprising polyester resin.

4. An electric fuse for elevated circuit voltages comprising (a) a fuse casing of a heat resisting electric insulating material;

(b) a unitary sub-assembly capable of being inserted as a whole into said casing;

(c) said sub-assembly including an electroconductive tubular plug member having a first section of relatively large outer diameter and a second section coaxial to said first section of relatively small outer diameter, said first section plugging one end of said casing and said second section projecting axially beyond said casing;

(d) said sub-assembly further including a cover obstructing the entrance from said casing into said tubular plug member, a blown fuse indicator including a biasing spring arranged at the axially outer end of said second section of said tubular plug member and a restraining wire loading said biasing spring of said blown fuse indicator, passing through an opening in said cover and having an abutment engaging said cover and maintaining under the action of said biasing spring of said blown fuse indicator said cover in engagement with said tubular plug member;

(e) said sub-assembly further including a metal plate arranged close to the other end of said casing and having an aperture for the admission of an arc-quenching filler into said casing;

(f) said sub-assembly further including a plurality of rods of electric insulating material arranged to form the edges of a prism, one of the ends of said plurality of rods being supported by the axially inner end of said tubular plug member and the opposite ends of said rods being supported by said metal plate;

(g) said sub-assembly further including a fusible element wound substantially helically around said rods and having one end conductively connected to said tubular plug member and the other end conductively connected to said metal plate;

(h) said sub-assembly further including a high resistance wire conductively connecting said metal plate and the axially inner end of said restraining wire;

(i) a pulverulent arc-quenching filler in said casing; and (j) a cap closing the other end of said casing and having lateral walls engaging the lateral walls of said casing.

* * * * *